US007965159B2

(12) United States Patent
Nakatani et al.

(10) Patent No.: US 7,965,159 B2
(45) Date of Patent: Jun. 21, 2011

(54) MICRO-SWITCHING DEVICE AND MANUFACTURING METHOD FOR THE SAME

(75) Inventors: Tadashi Nakatani, Kawasaki (JP); Anh Tuan Nguyen, Ho Chi Minh (VN); Satoshi Ueda, Kawasaki (JP); Yu Yonezawa, Yokohama (JP); Naoyuki Mishima, Yokohama (JP)

(73) Assignee: Fujitsu Limited, Kawasaki (JP)

( * ) Notice: Subject to any disclaimer, the term of this patent is extended or adjusted under 35 U.S.C. 154(b) by 1 day.

(21) Appl. No.: 11/987,885

(22) Filed: Dec. 5, 2007

(65) Prior Publication Data

US 2008/0210531 A1 Sep. 4, 2008

(30) Foreign Application Priority Data

Dec. 7, 2006 (JP) ..... 2006-330975

(51) Int. Cl.
*H01H 51/22* (2006.01)

(52) U.S. Cl. ..... 335/78; 200/181

(58) Field of Classification Search ..... 335/78; 200/181; 333/101

See application file for complete search history.

(56) References Cited

U.S. PATENT DOCUMENTS 5,629,565 A 5/1997 Schlaak et al.
6,054,659 A * 4/2000 Lee et al. ..... 200/181
6,426,687 B1 * 7/2002 Osborn ..... 333/262
6,657,525 B1 12/2003 Dickens et al.
6,720,201 B2 4/2004 Lee et al.
6,734,770 B2 * 5/2004 Aigner et al. ..... 335/78
6,856,219 B2 * 2/2005 Kawai ..... 335/78
6,960,971 B2 11/2005 Park et al.
7,002,441 B2 * 2/2006 Pillans et al. ..... 335/78
7,064,637 B2 * 6/2006 Tactic-Lucic et al. ..... 335/78
7,122,942 B2 * 10/2006 Song et al. ..... 310/328
7,123,119 B2 * 10/2006 Pashby et al. ..... 333/262
7,265,477 B2 * 9/2007 Wan ..... 310/309
7,312,677 B2 12/2007 Nakatani et al. ..... 335/78

(Continued)

FOREIGN PATENT DOCUMENTS

CN 1815657 A 8/2006

(Continued)

OTHER PUBLICATIONS

Office Action dated Oct. 30, 2009 issued in corresponding Korean Patent Application No. 10-2007-0125163.

(Continued)

*Primary Examiner* — Anh T Mai
*Assistant Examiner* — Bernard Rojas
(74) *Attorney, Agent, or Firm* — Kratz, Quintos & Hanson, LLP

(57) ABSTRACT

A micro-switching device includes a base substrate, a fixing member on the substrate, a movable part having an end fixed to the fixing member and extending along the substrate, a movable contact electrode provided on the movable part and facing away from the substrate, a pair of stationary contact electrodes bonded to the fixing member and including a region facing the movable contact electrode, a movable driver electrode between the movable contact electrode and the stationary end on the movable part at a surface facing away from the substrate, and a stationary driver electrode bonded to the fixing member and including an elevated portion having a region facing the movable driver electrode. The elevated portion is provided with steps facing the movable driver electrode, where the steps are closer to the substrate as they are farther from the movable contact electrode.

4 Claims, 20 Drawing Sheets

U.S. PATENT DOCUMENTS

| | | | | |
|---|---|---|---|---|
| 7,535,326 | B2 | 5/2009 | Nakatani et al. | 335/78 |
| 2004/0159532 | A1 | 8/2004 | Tatic-Lucic et al. | 200/181 |
| 2005/0225921 | A1 | 10/2005 | Nakatani et al. | |
| 2006/0220769 | A1* | 10/2006 | Chen | 335/78 |
| 2007/0115081 | A1* | 5/2007 | Kim et al. | 333/262 |

FOREIGN PATENT DOCUMENTS

| | | |
|---|---|---|
| JP | 8-255546 | 10/1996 |
| JP | 10-312734 | 11/1998 |
| JP | 2004-1186 | 1/2004 |
| JP | 2004-311394 | 11/2004 |
| JP | 2005-528751 | 9/2005 |
| JP | 2005-293918 | 10/2005 |
| KR | 10-2005-0087703 | 8/2005 |

OTHER PUBLICATIONS

Office Action dated May 20, 2010 issued in corresponding Chinese Patent application No. 200710196910.1.

* cited by examiner

MICRO-SWITCHING DEVICE AND MANUFACTURING METHOD FOR THE SAME

BACKGROUND OF THE INVENTION

1. Field of the Invention

The present invention relates to micro-switching devices manufactured by MEMS technology, and to a method of manufacturing switching devices by MEMS technology.

2. Description of the Related Art

In the field of radio communications equipment such as mobile telephones, there is an increasing demand for smaller RF circuitry due to the increase of parts needed to be incorporated for providing high performance. In response to such a demand, size reduction efforts are being made for a variety of parts necessary for constituting the circuitry, by using MEMS (micro-electromechanical systems) technology.

MEMS switches are examples of such parts. MEMS switches are switching devices in which each portion is formed by MEMS technology to have minute details, including e.g. at least one pair of contacts which opens and closes mechanically thereby providing a switching action, and a drive mechanism which works as an actuator for the mechanical open-close operations of the contact pair. In switching operations particularly for high-frequency signals in the Giga Hertz range, MEMS switches provide higher isolation when the switch is open and lower insertion loss when the switch is closed, than other switching devices provided by e.g. PIN diode and MESFET because of the mechanical separation achieved by the contact pair and smaller parasitic capacity as a benefit of mechanical switch. MEMS switches are disclosed in e.g. JP-A-2004-1186, JP-A-2004-311394, JP-A-2005-293918, and JP-A-2005-528751.

FIG. 19 through FIG. 23 show a conventional micro-switching device X3. FIG. 19 is a plan view of the micro-switching device X3, and FIG. 20 is a partial plan view of the micro-switching device X3. FIG. 21 through FIG. 23 are sectional views taken in lines XXI-XXI, XXII-XXII and XXIII-XXIII respectively in FIG. 19.

The micro-switching device X3 includes a base substrate S3, a fixing member 31, a movable part 32, a contact electrode 33, a pair of contact electrodes 34 (illustrated in phantom lines in FIG. 20), a driver electrode 35, and a driver electrode 36 (illustrated in phantom lines in FIG. 20).

As shown in FIG. 21 through FIG. 23, the fixing member 31 is bonded to the base substrate S3 via the boundary layer 37. The fixing member 31 and the base substrate S3 are formed of monocrystalline silicon whereas the boundary layer 37 is formed of silicon dioxide.

As shown in FIG. 19, FIG. 20 or FIG. 23 for example, the movable part 32 has a stationary end 32*a* fixed to the fixing member 31, as well as a free end 32*b*. The movable part extends along the base substrate S3, and is surrounded by the fixing member 31 via a slit 48. The movable part 32 is formed of monocrystalline silicon.

As shown in FIG. 20 and FIG. 23, the contact electrode 33 is near the free end 32*b* of the movable part 32. As shown in FIG. 21 and FIG. 23, each contact electrode 34 is formed on the fixing member 31 and has a region facing the contact electrode 33. Also, each contact electrode 34 is connected with a predetermined circuit selected as an object of switching operation, via predetermined wiring (not illustrated). The contact electrodes 33, 34 are formed of a predetermined electrically conductive material.

As shown in FIG. 20 and FIG. 22 for example, the driver electrode 35 is on the movable part 32. Also, the driver electrode 35 is connected with wiring 39 which is laid on the movable part 32 and on the fixing member 31. The driver electrode 35 and the wiring 39 are formed of a predetermined electrically conductive material. The driver electrode 35 and the wiring 39 such as the above are formed by means of thin-film formation technology, and during their formation process, an internal stress develops in the driver electrode 35 and the wiring 39. Because of the internal stress, the driver electrode 35 and the wiring 39, as well as the movable part 32 bonded thereto are warped as shown in FIG. 23. Specifically, the warping or deformation of the movable part 32 causes the free end 32*b* of the movable part 32 to come closer to the contact electrode 34. The amount of displacement of the free end 32*b* toward the contact electrode 34 depends on the length and the spring constant of the movable part 32, ranging from 1 through 10 μm approximately.

As shown in FIG. 22, the driver electrode 36 has its ends bonded to the fixing member 31 so as to bridge over the driver electrode 35. Also, the driver electrode 36 is grounded via predetermined wiring (not illustrated). The driver electrode 36 is formed of a predetermined electrically conductive material.

In the micro-switching device X3 arranged as described above, electrostatic attraction is generated between the driver electrodes 35, 36 when an electric potential is applied to the driver electrode 35 via the wiring 39. With the applied electric potential being sufficiently high, the movable part 32, which extends along the base substrate S3, is elastically deformed until the contact electrode 33 makes contact with both of the contact electrodes 34, and thus a closed state of the micro-switching device X3 is achieved. In the closed state, the pair of contact electrodes 34 are electrically connected with each other by the contact electrode 33, to allow an electric current to pass through the contact electrodes 34. In this way, it is possible to achieve an ON state of e.g. a high-frequency signal.

On the other hand, with the micro-switching device X3 assuming the closed state, if the application of the electric potential is removed from the driver electrode 35 whereby the electrostatic attraction acting between the driver electrodes 35, 36 is cancelled, the movable part 32 returns to its natural state, causing the contact electrode 33 to come off the contact electrodes 34. In this way, an open state of the micro-switching device X3 as shown in FIG. 21 and FIG. 23 is achieved. In the open state, the pair of contact electrodes 34 are electrically separated from each other, preventing an electric current from passing through the contact electrodes 34. In this way, it is possible to achieve an OFF state of e.g. a high-frequency signal.

Generally, the driving voltage of a micro-switching device should be low. For micro-switching devices of an electrostatically driven type, the driving voltage can be reduced effectively by reducing the gap between the cooperating driver electrodes. The electrostatic attraction between the driver electrodes is proportional to the square of the distance (gap) between the driver electrodes, which means that the smaller the distance between the driver electrodes, the smaller is the voltage necessary to generate the electrostatic attraction, i.e. the driving force. However, in the conventional micro-switching device X3, it is difficult or even impossible to achieve sufficient reduction in the driving voltage by making small the gap G between the driver electrodes 35, 36.

In the micro-switching device X3, the free end 32*b* of the movable part 32 comes closer to the contact electrode 34 due to the deformation or warp of the movable part 32, as described above. For this reason, as shown in FIG. 23, the gap G between the driver electrodes 35, 36 when the device is in the non-operating state or the open state becomes wider as the distance from the contact electrodes 33, 34 increases. Specifically, with a distance D1 being the distance between the driver electrodes 35, 36 at a location on the driver electrode 35 on a side farther from the contact electrodes 33, 34, and a distance D2 being the distance between the driver electrodes 35, 36 at a location on the driver electrode 35 on a side closer to the contact electrodes 33, 34, the distance D1 is greater than the distance D2. Referring to FIG. 20, in a case where the driver electrode 35 has a length L1 of 200 μm, the difference between the distance D1 and the distance D2 can sometimes as large as 2 μm. In other words, if the length L4 of the driver electrode 35 is 200 μm, the distance D1 can be larger than the distance D2 by as much as 2 μm even if the distance D2 is made as small as possible. In the driver electrode 35, 36 such as the above, an amount of electrostatic attraction generated at a location of the driver electrode 35 on a side farther from the contact electrodes 33, 34 is substantially smaller than an amount of electrostatic attraction generated at a location of the driver electrode 35 on a side closer to the contact electrodes 33, 34.

As described above, in the micro-switching device X3, the distance D1 is undesirably larger than the distance D2, and therefore it is impossible to make the gap G between the driver electrodes 35, 36 sufficiently small, and as a result, it is sometimes impossible to achieve sufficient reduction in the driving voltage.

SUMMARY OF THE INVENTION

The present invention has been proposed under the above-described circumstances, and it is therefore an object of the present invention to provide a micro-switching device suitable for reducing the driving voltage. It is another object of the present invention to provide a method for manufacturing such a micro-switching device.

According to a first aspect of the present invention, there is provided a micro-switching device that comprises a base substrate, a fixing member bonded to the base substrate, and a movable part including a stationary end fixed to the fixing member, where the movable part extends along the base substrate. The micro-switching device further comprises a movable contact electrode provided on the movable part at a surface facing away from the base substrate, a pair of stationary contact electrodes each including a region facing the movable contact electrode and each bonded to the fixing member, a movable driver electrode provided between the movable contact electrode and the stationary end on the movable part at a surface facing away from the base substrate, and a stationary driver electrode bonded to the fixing member and including an elevated portion having a region facing the movable driver electrode. The elevated portion has a step structure provided by two or more steps facing the movable driver electrode, where the steps are arranged to be closer to the base substrate as these steps are farther from the movable contact electrode.

When the present micro-switching device is in a non-operating state or open state, the movable part is in a deformed or warped state in substantially the same way as described earlier for the conventional micro-switching device; i.e. the free end which is the end away from the stationary end is closer to the stationary contact electrode. However, according to the present micro-switching device, the elevated portion of the stationary driver electrode has a step structure (in which a step which is farther from the movable contact electrode than other steps is closer to the base substrate) as described earlier. This arrangement is suitable for sufficiently reducing the difference in the two distances, i.e. the distance (first distance) between the driver electrodes on the side farther from the movable contact electrode and the distance (second distance) between the driver electrodes on the side closer to the movable contact electrode. Thus, according to the present micro-switching device, it is possible to make the first distance equal to the second distance. According to the present micro-switching device described above, it is possible to make the gap between the driver electrodes sufficiently small. Therefore, the present micro-switching device is suitable for reducing the driving voltage.

Preferably, the stationary driver electrode may comprise a projection which protrudes from the elevated portion toward the movable driver electrode, where the projection can be brought into and out of contact with the movable part. More preferably, the movable driver electrode, provided on the movable part, is formed with an opening for partial exposure of the movable part at a position corresponding to the above-mentioned projection. This arrangement is suitable for preventing the two driver electrodes from coming into contact with each other when the micro-switching device is switched to the closed state, i.e. a state where the stationary contact electrodes are bridged by the movable contact electrode.

According to a second aspect of the present invention, there is provided a method of making a micro-switching device of the above-described first aspect by processing a material substrate having a laminated structure including a first layer, a second layer and an intermediate layer between the first and the second layers. In accordance with this method, the following steps are performed. First, the movable contact electrode and the movable driver electrode are formed on the first layer at a first portion to be processed into the movable part. Then, the fixing member and the movable part are formed by subjecting the first layer to anisotropic etching until the intermediate layer is reached. In this step, the anisotropic etching is performed via a masking pattern to mask the first portion and a second portion of the first layer to be processed into the fixing member. Then, a sacrifice film is formed to cover a first-layer side of the material substrate. Then, a predetermined number of recesses are formed in the sacrifice film for forming the elevated portion of the step structure ("recess forming step"). The position of the recesses corresponds to the position of the movable driver electrode. Then, a plurality of openings are made in the sacrifice film for exposing regions of the fixing member to which the pair of stationary contact electrodes and the stationary driver electrode are to be bonded ("opening forming step"). Then, the stationary driver electrode and the pair of stationary contact electrodes are formed in a manner such that the stationary driver electrode is bonded to the fixing member and includes at least the elevated portion having a region facing the movable driver electrode via the sacrifice film, while the pair of stationary contact electrodes each are bonded to the fixing member and have a region facing the movable contact electrode via the sacrifice film. Then, the sacrifice film is removed ("sacrifice film removing step"), and further the intermediate layer, provided between the second layer and the movable part, is removed by etching ("layer etching step"). The recess forming step may be performed before or after the opening forming step. The sacrifice film removing step and the layer etching step may be performed substantially continuously, as a single process. The method of the present invention enables one to make a micro-switching device of the first aspect properly.

Preferably, the method of the present invention may further comprise the step of forming a recess in the sacrifice film for forming a projection protruding from the elevated portion toward the movable driver electrode. This additional step may be performed before or simultaneously with or after the recess forming step. In accordance with the method including this additional step, the resulting stationary driver electrode has the projection in addition to the elevated portion.

Other features and advantages of the present invention will become apparent from the detailed description given below with reference to the accompanying drawings.

DETAILED DESCRIPTION OF THE PREFERRED EMBODIMENTS

Figure 1:
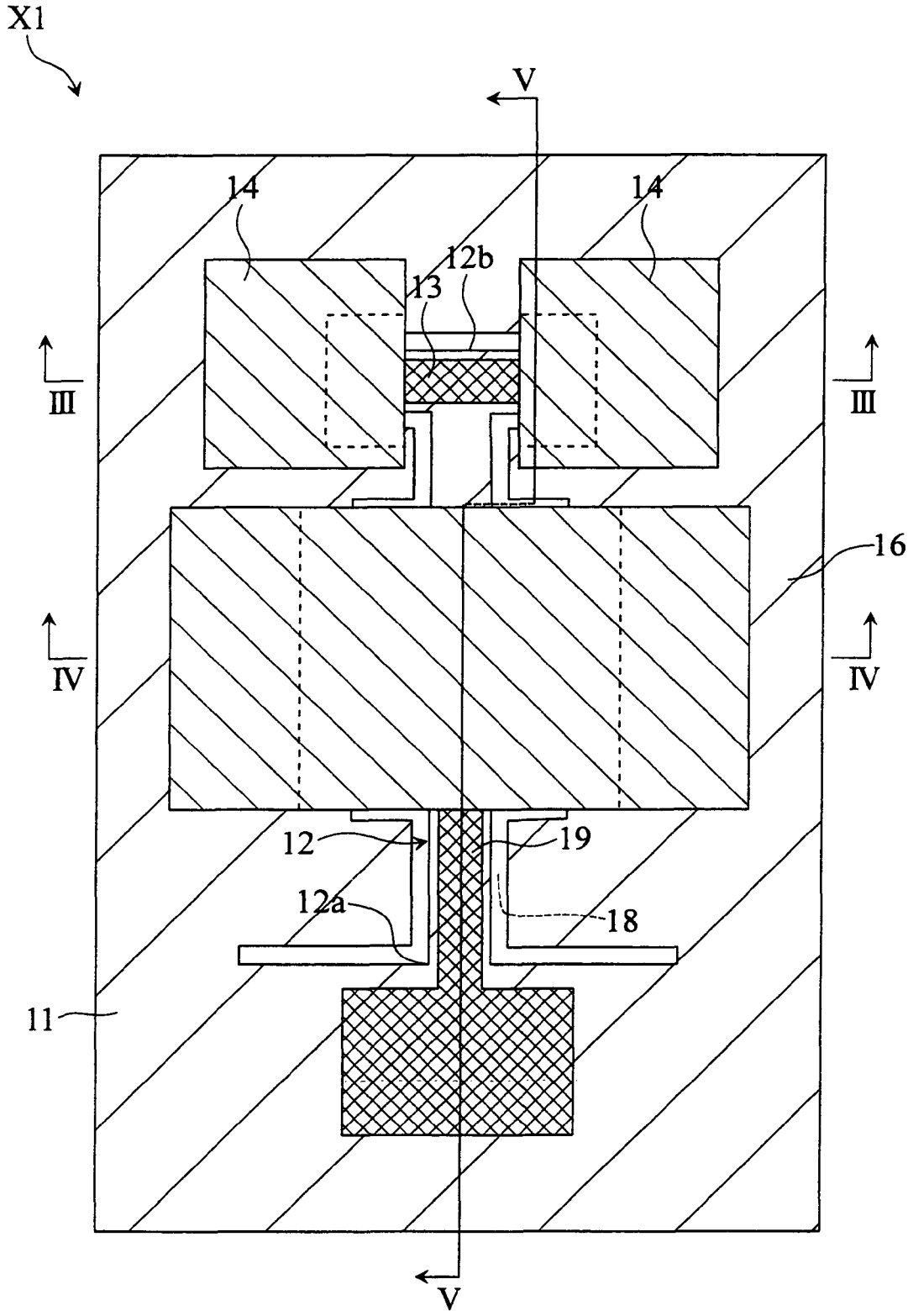
FIG. 1 is a plan view showing a micro-switching device according to a first embodiment of the present invention.
Figure 2:
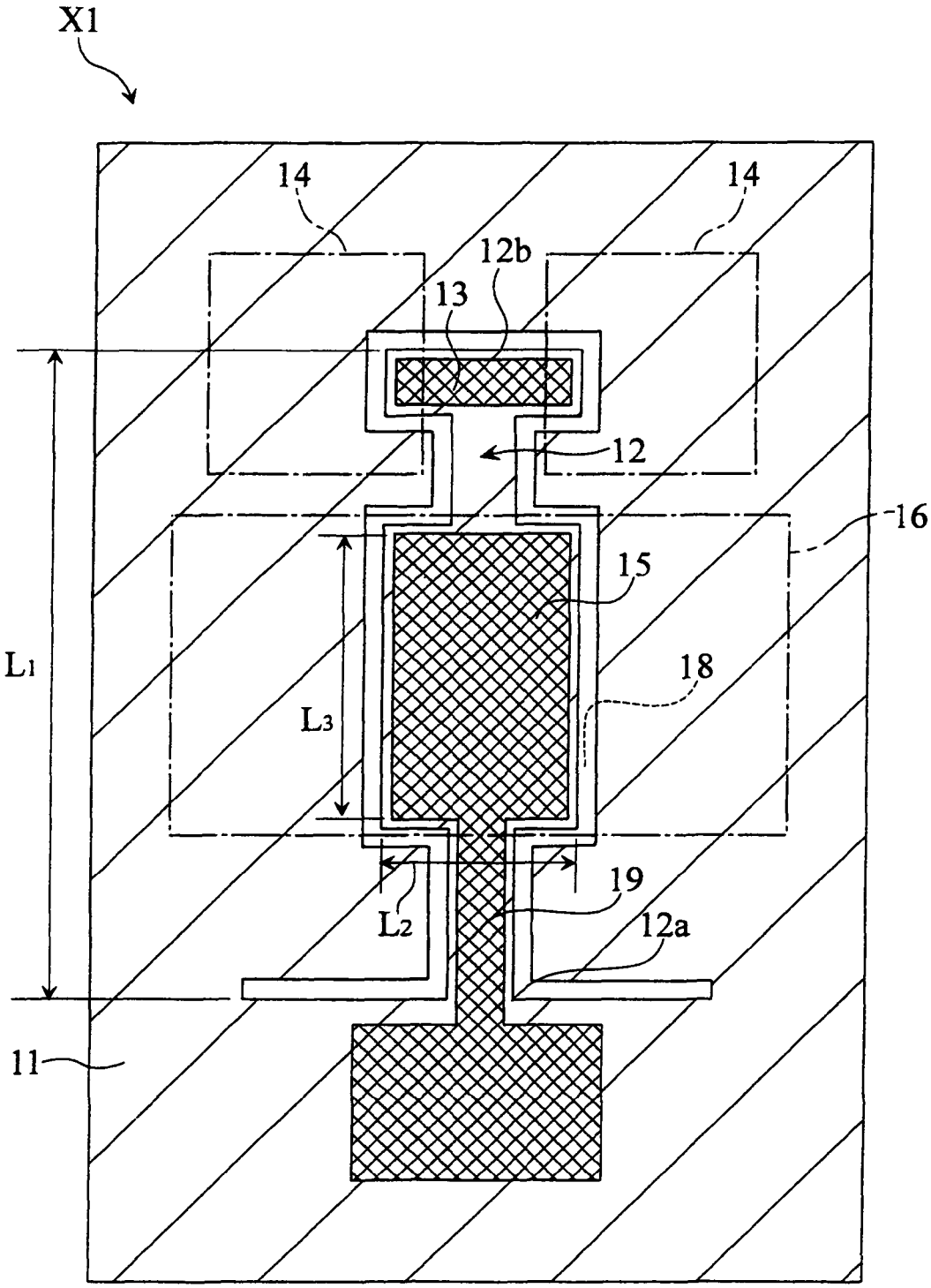
FIG. 2 is a plan view showing the device of FIG. 1, with some parts omitted.
Figure 3:
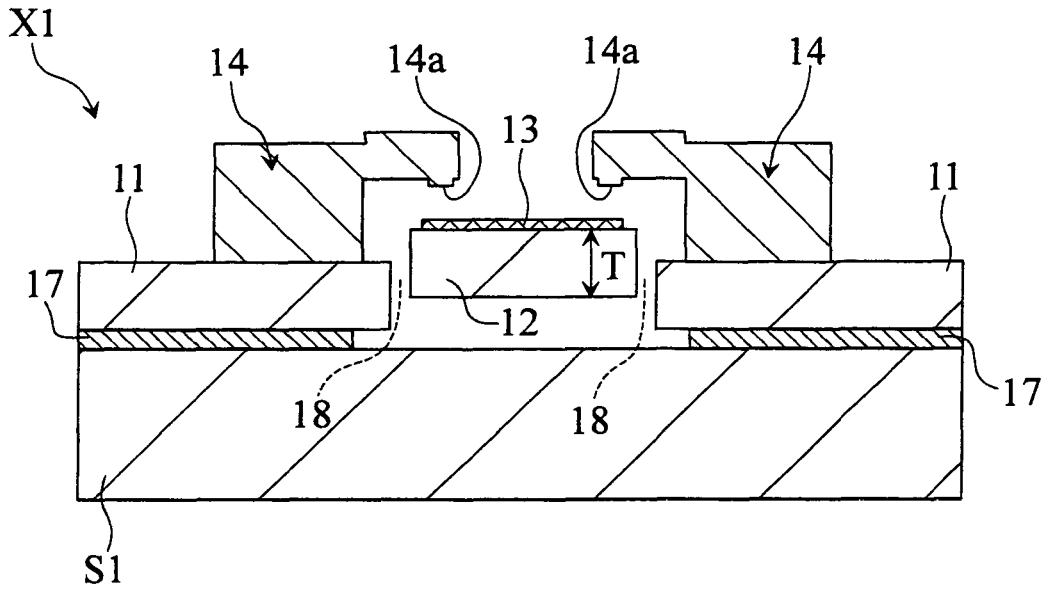
FIG. 3 is a sectional view taken along lines III-III in FIG. 1.
Figure 4:
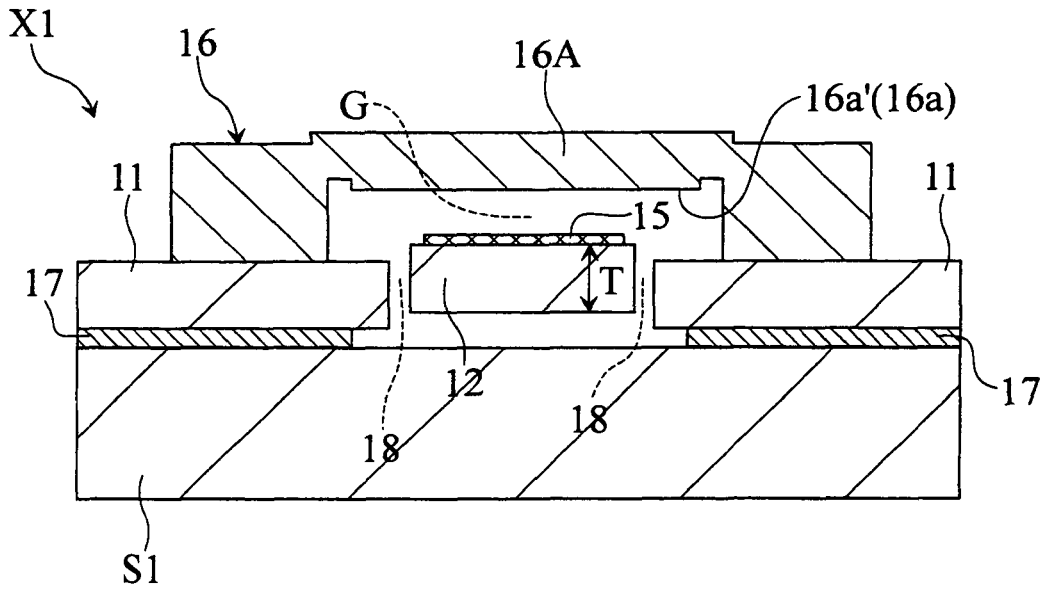
FIG. 4 is a sectional view taken along lines IV-IV in FIG. 1.
Figure 5:
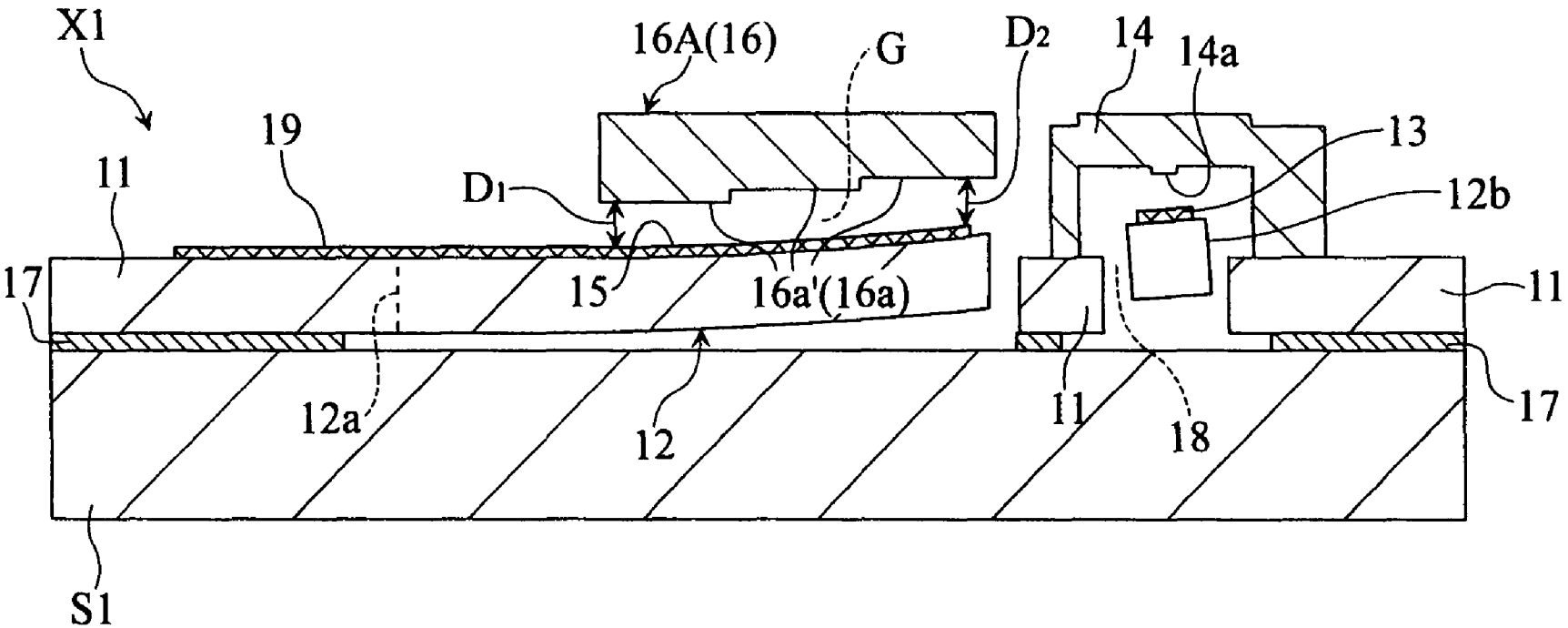
FIG. 5 is a sectional view taken along lines V-V in FIG. 1.

FIG. 1 through FIG. 5 show a micro-switching device X1 according to a first embodiment of the present invention. FIG. 1 is a plan view of the micro-switching device X1, and FIG. 2 is a partial plan view of the micro-switching device Xl. FIG. 3 through FIG. 5 are sectional views taken in lines III-III, IV-IV, and V-V respectively in FIG. 1.

The micro-switching device Xl includes a base substrate S1, a fixing member 11, a movable part 12, a contact electrode 13, a pair of contact electrodes 14 (illustrated in phantom lines in FIG. 2), a driver electrode 15, and a driver electrode 16 (illustrated in phantom lines in FIG. 2).

As shown in FIG. 3 through FIG. 5, the fixing member 11 is bonded to the base substrate S1 via a boundary layer 17. The fixing member 11 is formed of e.g. monocrystalline silicon. The silicon material for the fixing member 11 preferably has a resistivity not smaller than 1000 ohm·cm. The boundary layer 17 is formed of silicon dioxide for example.

As shown in FIG. 1, FIG. 2 or FIG. 5 for example, the movable part 12 has a stationary end 12*a* fixed to a fixing member 11, and a free end 12*b*, extends along the base substrate S1, and is surrounded by the fixing member 11 via a slit 18. The movable part 12 has a thickness T in FIG. 3 and FIG. 4, which is not greater than 15 μm. Also, as shown in FIG. 2, the movable part 12 has a length L1 which is e.g. 500 through 1200 μm, and a length L2 which is e.g. 100 through 400 μm. The slit 18 has a width of e.g. 1.5 through 2.5 μm. The movable part 12 is formed e.g. of monocrystalline silicon.

The contact electrode 13 serves as a movable contact electrode according to the present invention, and as shown in FIG. 2, is provided near the free end 12*b* on the movable part 12. The contact electrode 13 has a thickness of e.g. 0.5 through 2.0 μm. Such a range of thickness is preferable for reduced resistivity of the contact electrode 13. The contact electrode 13 is formed of a predetermined electrically conductive material, and has e.g. a laminated structure provided by a Mo underlayer film and a Au film formed thereon.

Each contact electrode 14 serves as a stationary contact electrode according to the present invention, is built on the fixing member 11 as shown in FIG. 3 and FIG. 5, and has a projection 14*a* faced toward the contact electrode 13. The projection 14*a* has a length of projection which is 0.5 through 5 μm. Each contact electrode 14 is connected with a predetermined circuit selected as an object of switching operation, via predetermined wiring (not illustrated). The contact electrodes 14 may be formed of Au.

The driver electrode 15 serves as a movable driver electrode according to the present invention, and as shown in FIG. 2, is built on the movable part 12. The driver electrode 15 has a length L3 in FIG. 2 of e.g. 50 through 300 μm. The driver electrode 15 as described is connected with wiring 19 which is laid on the movable part 12 and on the fixing member 11. The driver electrode 15 and the wiring 19 may be formed of the same material as of the contact electrode 13.

The driver electrode 15 and the wiring 19 such as the above are formed by means of thin-film formation technology as will be detailed later, and during their formation process, an internal stress develops in the driver electrode 15 and the wiring 19. Because of the internal stress, the driver electrode 15 and the wiring 19 as well as the movable part 12 bonded thereto are distorted as shown in FIG. 5. In other words, the free end 12*b* of the movable part 12 comes closer to the contact electrode 14 as a result of the deformation or the warp of the movable part 12. The amount of displacement of the free end 12*b* toward the contact electrode 14 depends on the length and the spring constant of the movable part 12, ranging from 1 through 10 μm approximately.

Figure 6:
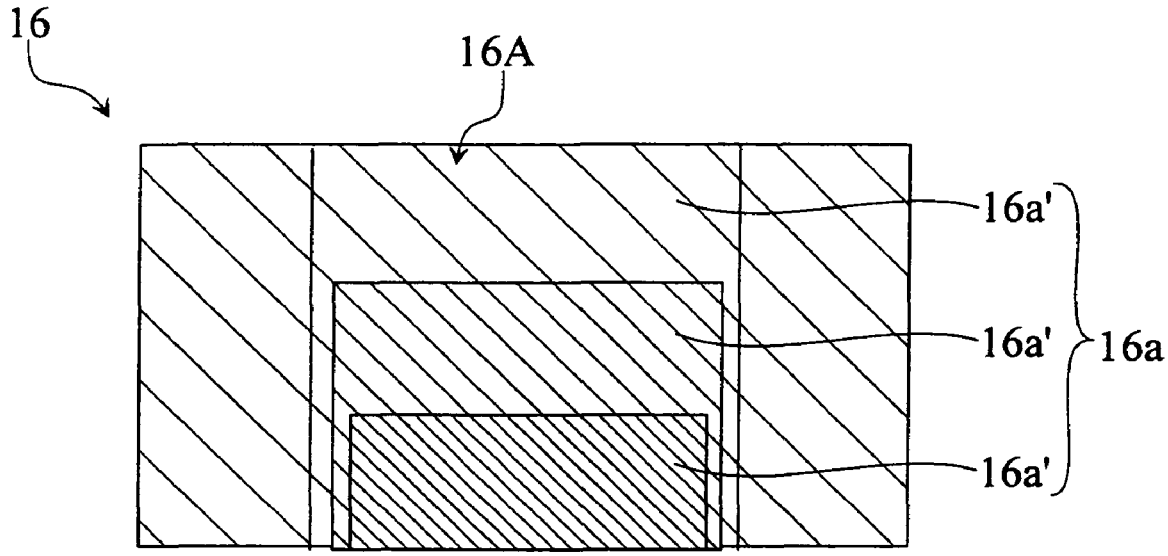
FIG. 6 shows a driver electrode (stationary driver electrode) as viewed from the base substrate.

The driver electrode 16 serves as a stationary driver electrode according to the present invention, has its two ends bonded to the fixing member 11 as shown in FIG. 4, and has an elevated portion 16A which bridges over the driver electrode 15. As shown in FIG. 5 and also in FIG. 6, the elevated portion 16A has a step structure 16*a* provided by a plurality of steps 16*a*', on a side facing the driver electrode 15. FIG. 6 is a plan view of the driver electrode 16 as viewed from the side facing the base substrate S1. The farther is the step 16*a*' from the contact electrode 13 in the step structure 16*a*, the closer it is to the base substrate S1. The number of the steps are three in the present embodiment; however, the number may be four or greater. Referring to FIG. 5, a distance D1 is the distance between the driver electrodes 15, 16 at a location on the driver electrode 15 on the side farther from the contact electrode 13, and a distance D2 is the distance between the driver electrodes 15, 16 at a location on the driver electrode 15 on the side closer to the contact electrode 13. Preferably, both of the distances have a value of e.g. 1 through 3 μm. Preferably, the difference between the distance D1 and the distance D2 is not greater than 0.2 μm. The driver electrode 16 as described above is grounded via predetermined wiring (not illustrated). The driver electrodes 16 may be formed of the same material as is the contact electrodes 14.

In the micro-switching device X1 arranged as the above, electrostatic attraction is generated between the driver electrodes 15, 16 when an electric potential is applied to the driver electrode 15 via the wiring 19. With the applied electric potential being sufficiently high, the movable part 12 is elastically deformed until the contact electrode 13 makes contact with the pair of contact electrodes 14, and thus a closed state of the micro-switching device X1 is achieved. In the closed state, the pair of contact electrodes 14 are electrically connected with each other by the contact electrode 13 to allow an electric current to pass through the contact electrodes 14. In this way, it is possible to achieve an ON state of e.g. a high-frequency signal.

On the other hand, with the micro-switching device X1 which now assumes the closed state, if the application of the electric potential is removed from the driver electrode 15, whereby the electrostatic attraction acting between the driver electrodes 15, 16, is cancelled, the movable part 12 returns to its natural state, causing the contact electrode 13 to come off the contact electrodes 14. In this way, the open state of the micro-switching device X1 as shown in FIG. 3 and FIG. 5 is achieved. In the open state, the pair of contact electrodes 14 are electrically separated from each other, preventing an electric current from passing through the contact electrodes 14. In this way, it is possible to achieve an OFF state of e.g. a high-frequency signal. The micro-switching device X1 which assumes such an open state as the above can be switched to the closed state again, by performing a sequence of closed state achieving processes which has been described earlier.

As has been described, according to the micro-switching device X1, it is possible to selectively switch between a closed state where the contact electrode 13 makes contact with both of the contact electrodes 14, and an open state where the contact electrode 13 is moved off both of the contact electrodes 14.

In a non-operating state or open state of the micro-switching device X1, the movable part 12 is in a state of deformation or warp. However, in the micro-switching device X1, the elevated portion 16A of the driver electrode 16 has a step structure 16*a* (in which the step 16*a*' that is farther from the contact electrode 13 is closer to the base substrate S1). This arrangement is suitable for sufficiently reducing the difference between the distance D1 between the driver electrodes 15, 16 on the side farther from the contact electrode 13 and the distance D2 between the driver electrodes 15, 16 on the side closer to the contact electrode 13. Thus, according to the micro-switching device X1, it is possible to make the distance D1 equal to the distance D2. The electrostatic attraction between the driver electrodes 15, 16 is proportional to the square of the distance (gap G) between the driver electrodes 15, 16, which means that the smaller the distance between the driver electrodes 15, 16, the smaller is the voltage which is necessary to generate a predetermined electrostatic attraction, i.e. the driving force. Hence, according to the micro-switching device X1 described above, it is possible to make the gap G sufficiently small between the driver electrodes 15, 16, and therefore the micro-switching device X1 is suitable for reducing the driving voltage.

Figure 7:
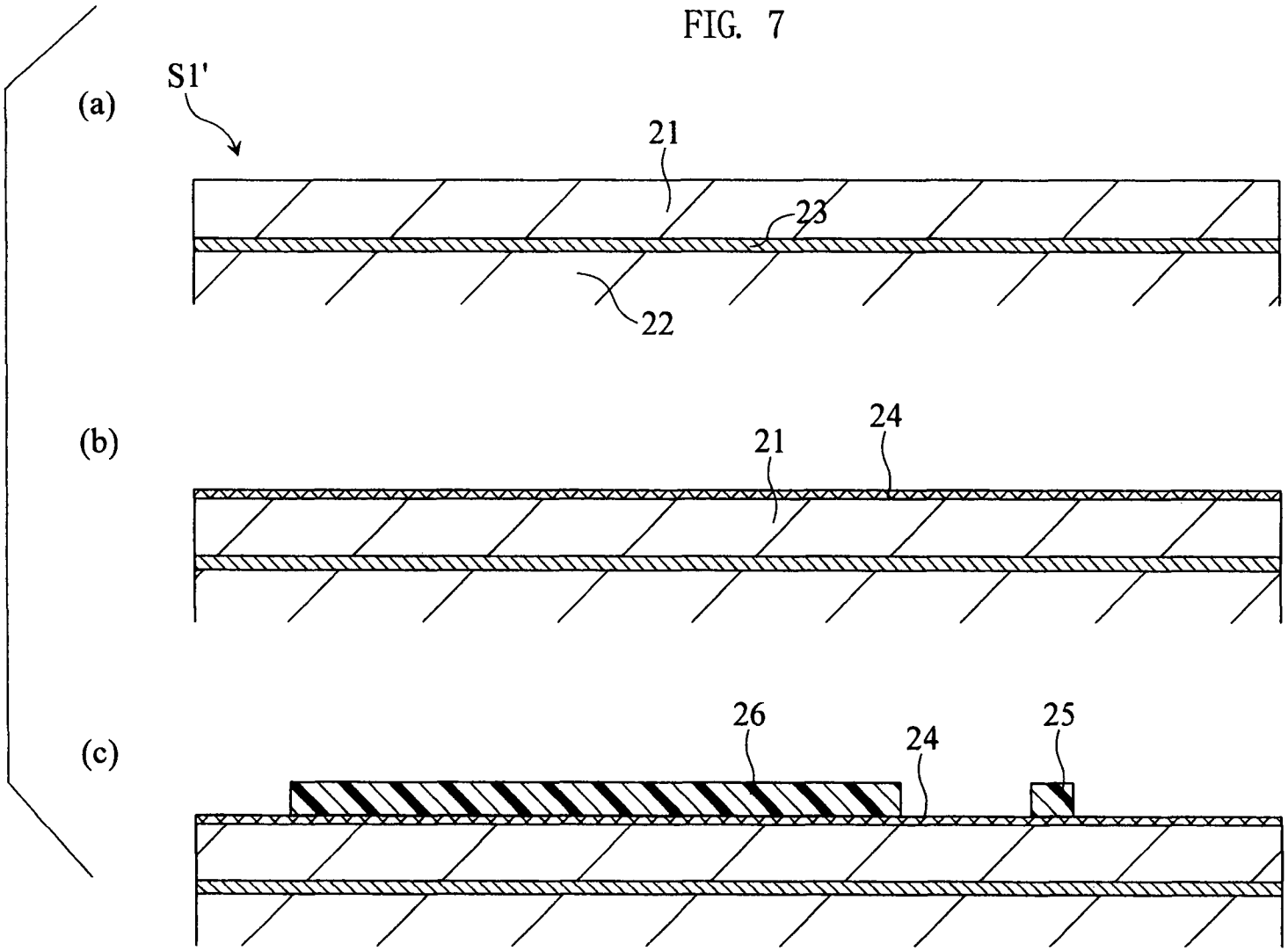
FIG. 7 shows steps of a method of making the micro-switching device shown in FIG. 1.

FIG. 7 through FIG. 11 show a method of making the micro-switching device X1 in a series of sectional views illustrating changes in a section which corresponds to the section illustrated in FIG. 5. In the present method, first, a material substrate S1' as shown in FIG. 7(*a*) is prepared. The material substrate S1' is an SOI (Silicon on Insulator) substrate having a laminated structure which includes a first layer 21, a second layer 22 and an intermediate layer 23 between them. In the present embodiment, the first layer 21 has a thickness of 15 μm, the second layer 22 has a thickness of 525 μm, and the intermediate layer 23 has a thickness of 4 μm, for example. The first layer 21 is formed e.g. of monocrystalline silicon, and is processed into the fixing member 11 and the movable part 12. The second layer 22 is formed e.g. of monocrystalline silicon, and is processed into the base substrate S1. The intermediate layer 23 is formed e.g. of silicon dioxide, and is processed into the boundary layer 17.

Next, as shown in FIG. 7(*b*), a conductive film 24 is formed on the first layer 21 by using e.g. spattering method: A film of Mo is formed on the first layer 21 and then a film of Au is formed thereon. The Mo film has a thickness of e.g. 30 nm while the Au film has a thickness of e.g. 500 nm.

Next, as shown in FIG. 7(*c*), resist patterns 25, 26 are formed on the conductive film 24 by photolithography: The resist pattern 25 has a pattern for the contact electrode 13. The resist pattern 26 has a pattern for the driver electrode 15 and the wiring 19.

Figure 8:
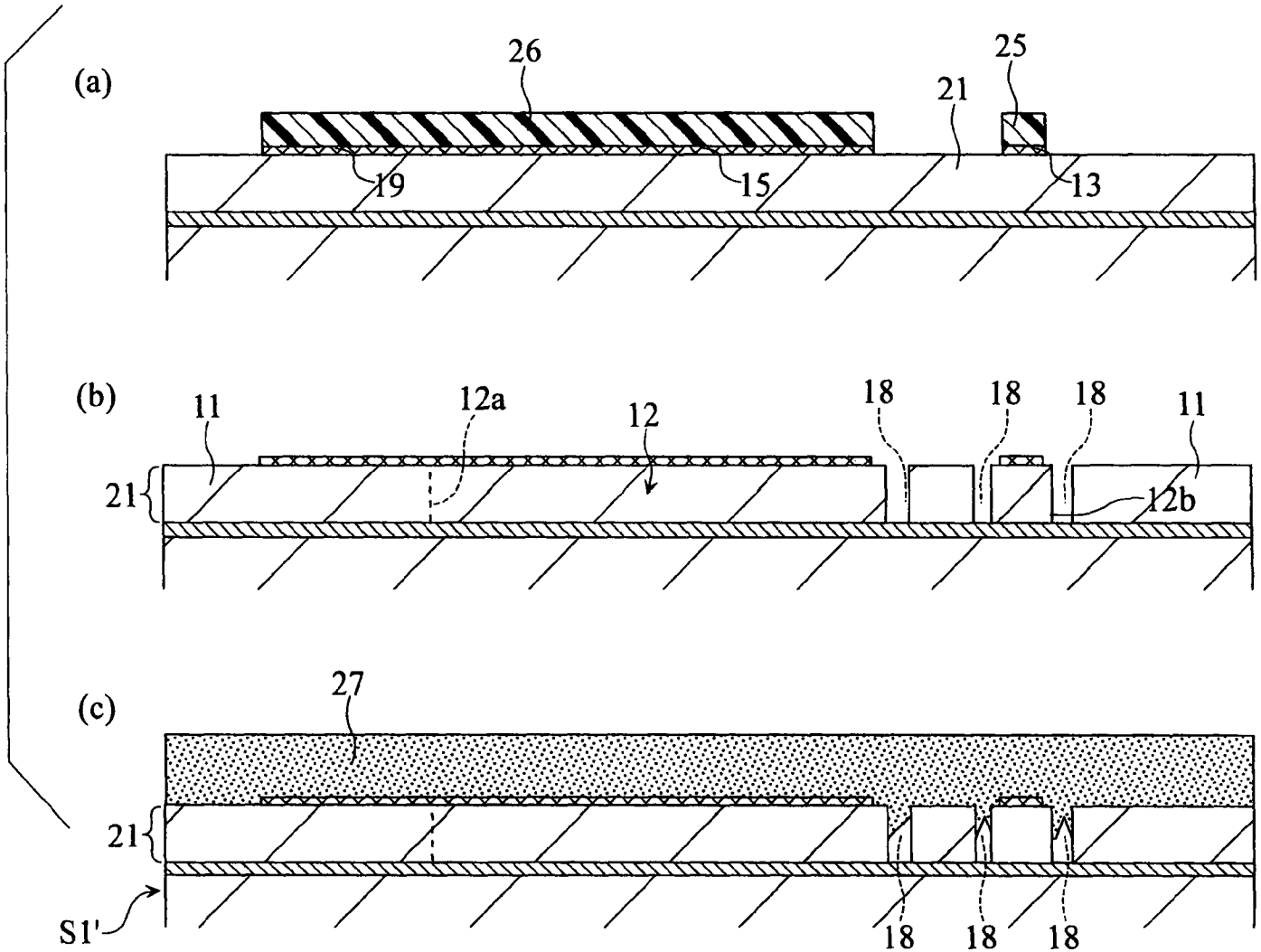
FIG. 8 shows steps following the steps of FIG. 7.

Next, as shown in FIG. 8(*a*), by using the resist patterns 25, 26 as masks, etching is performed to the conductive film 24 to form a contact electrode 13, a driver electrode 15 and wiring 19 on the first layer 21. The etching method to be employed in the present step may be ion milling (physical etching by e.g. Ar ions). Ion milling may also be used as a method of etching metal materials to be described later.

Next, the resist patterns 25, 26 are removed. Thereafter, as shown in FIG. 8(*b*), the first layer 21 is etched to form a slit 18. Specifically, a predetermined resist pattern is formed on the first layer 21 by photolithography, and then anisotropic etching is performed to the first layer 21, using the resist pattern as a mask. The etching method to be employed may be reactive ion etching. In the present step, a fixing member 11 and a movable part 12 are patterned.

Next, as shown in FIG. 8(*c*), a sacrifice layer 27 is formed on the first layer 21 side of the material substrate S1', masking the slit 18. The sacrifice layer may be formed of e.g. silicon dioxide. The sacrifice layer 27 may be formed by e.g. plasma CVD method, spattering method, etc.

Figure 9:
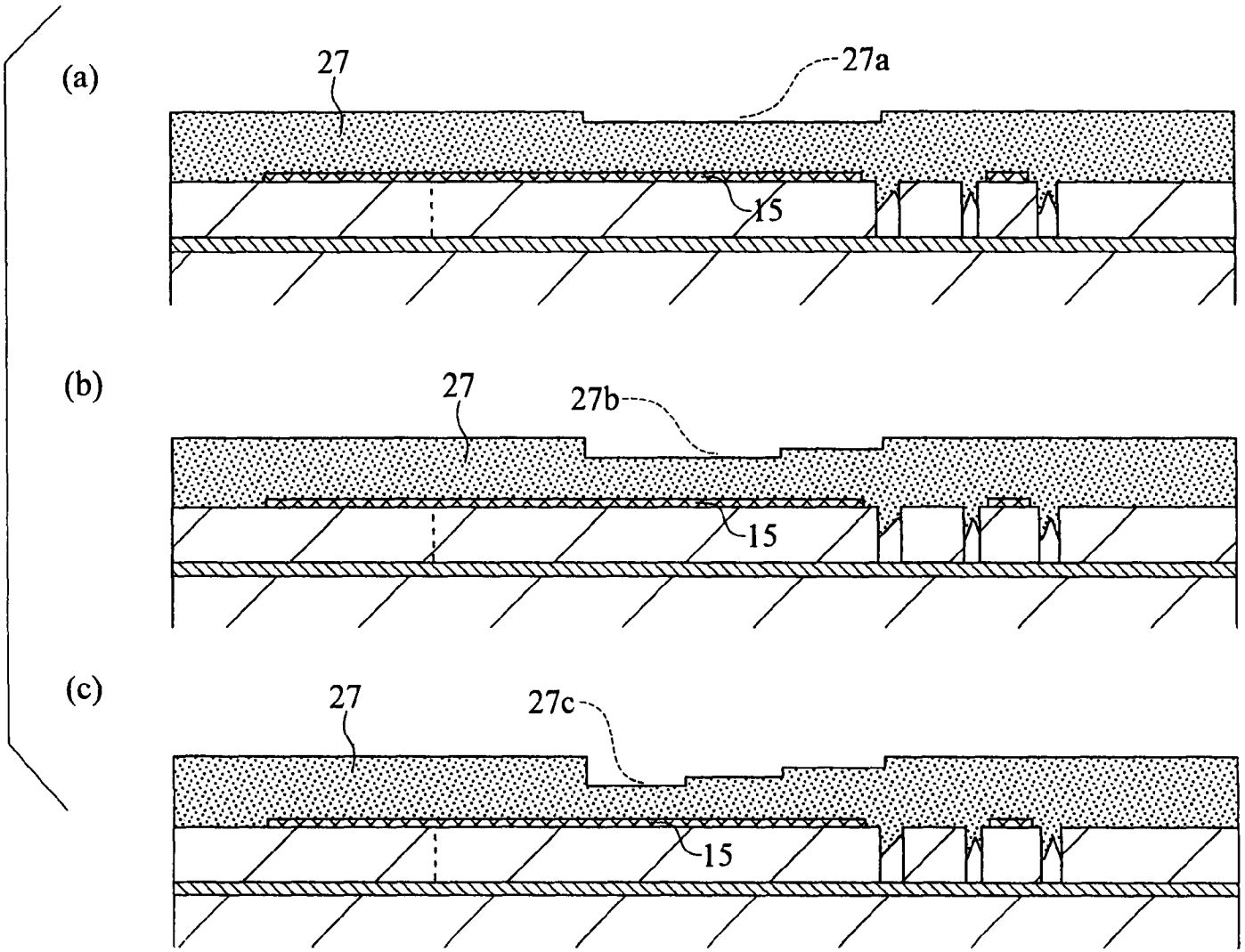
FIG. 9 shows steps following the steps of FIG. 8.

Next, as shown in FIG. 9(*a*), a recess 27*a* is formed at a location in the sacrifice layer 27 correspondingly to the driver electrode 15. Specifically, a predetermined resist pattern is formed on the sacrifice layer 27 by photolithography, and then etching is performed to the sacrifice layer 27, using the resist pattern as a mask. The etching may be wet etching. For the wet etching, the etchant may be provided by e.g. buffered hydrofluoric acid (BHF). Other recesses to be described later may also be formed by the same method as used for the recess 27*a*. The recess 27*a* is for formation of a step in the step structure 16*a* of the elevated portion 16A in the driver electrode 16. The recess 27*a* has a depth of 0.5 through 3 μm.

Next, as shown in FIG. 9(*b*), a recess 27*b* is formed at a location in the sacrifice layer 27 correspondingly to the driver electrode 15. The recess 27*b* is for formation of a step in the step structure 16*a* of the elevated portion 16A in the driver electrode 16. The recess 27*b* has a depth of 0.2 through 1 μm.

Next, as shown in FIG. 9(*c*), a recess 27*c* is formed at a location in the sacrifice layer 27 correspondingly to the driver electrode 15. The recess 27*c* is for formation of a step in the step structure 16*a* of the elevated portion 16A in the driver electrode 16. The recess 27*c* has a depth of 0.2 through 1 μm.

Figure 10:
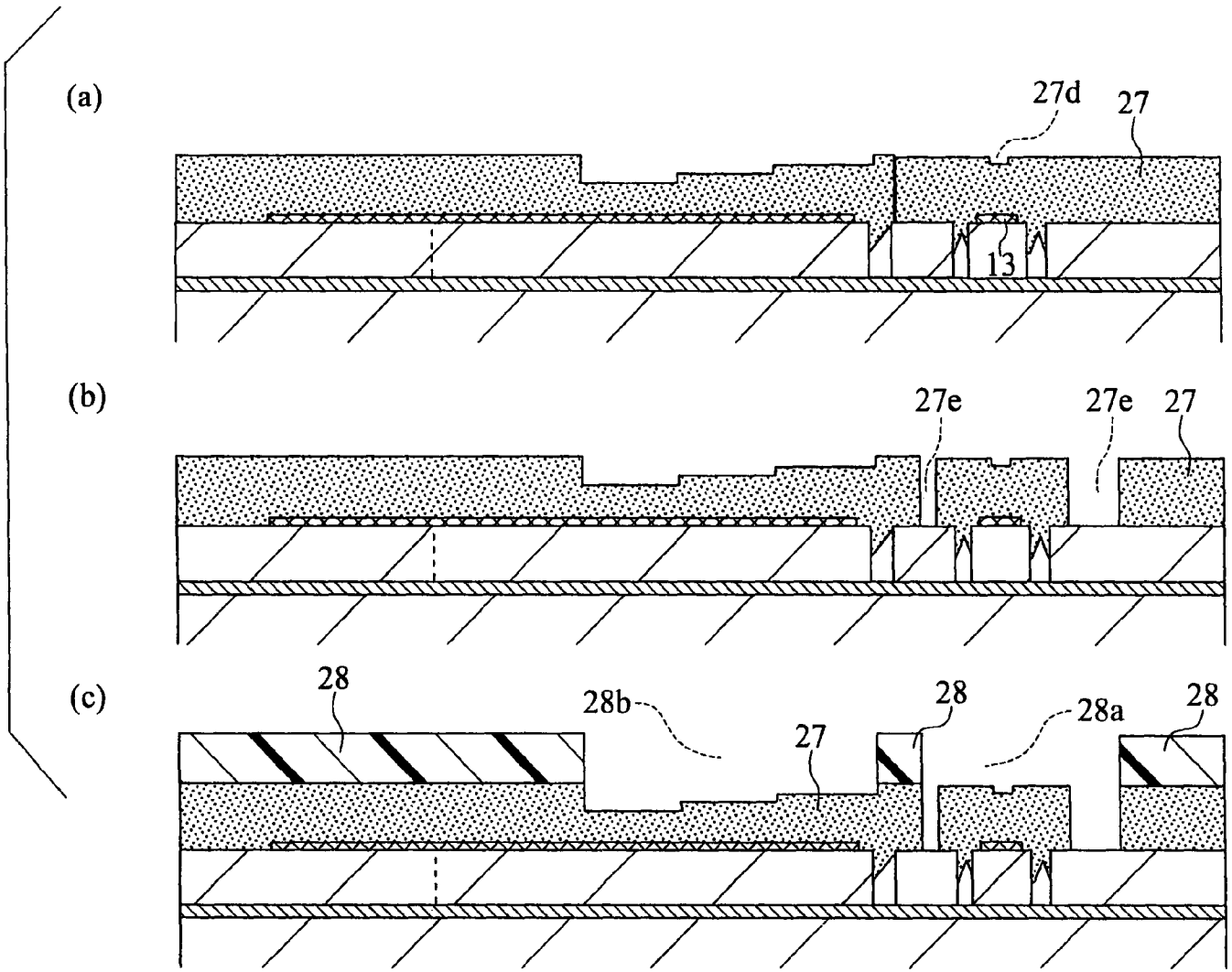
FIG. 10 shows steps following the steps of FIG. 9.

Next, as shown in FIG. 10(*a*), recesses 27*d* are formed at a location in the sacrifice layer 27 correspondingly to the contact electrode 13. The recesses 27*d* are for formation of projections 14*a* in the contact electrodes 14. The recesses 27*d* have a depth of 0.5 through 5 μm.

Next, as shown in FIG. 10(*b*), the sacrifice layer 27 is patterned to make an opening 27*e*. Specifically, a predetermined resist pattern is formed on the sacrifice layer 27 by photolithography, and then the sacrifice layer 27 is etched, using the resist pattern as a mask. The etching may be wet etching. The opening 27*e* exposes a region in the fixing member 11 for the bonding of the contact electrodes 14. In the present step, other openings (not shown) are also made by patterning the sacrifice layer 27 in order to expose regions in the fixing member 11 for the bonding of the driver electrode 14.

Next, an underlying film (not illustrated) to be used for supplying power during an electroplating process is formed on a surface of the material substrate S1' which has been formed with the sacrifice layer 27. Thereafter, as shown in FIG. 10(*c*), a resist pattern 28 is formed. The underlying film can be formed by spattering method for example, by first forming a film of Mo to a thickness of 50 nm and then forming a film of Au thereon, to a thickness of 500 nm. The resist pattern 28 has an opening 28*a* for formation of contact electrodes 14, and an opening 28*b* for formation of a driver electrode 16.

Figure 11:
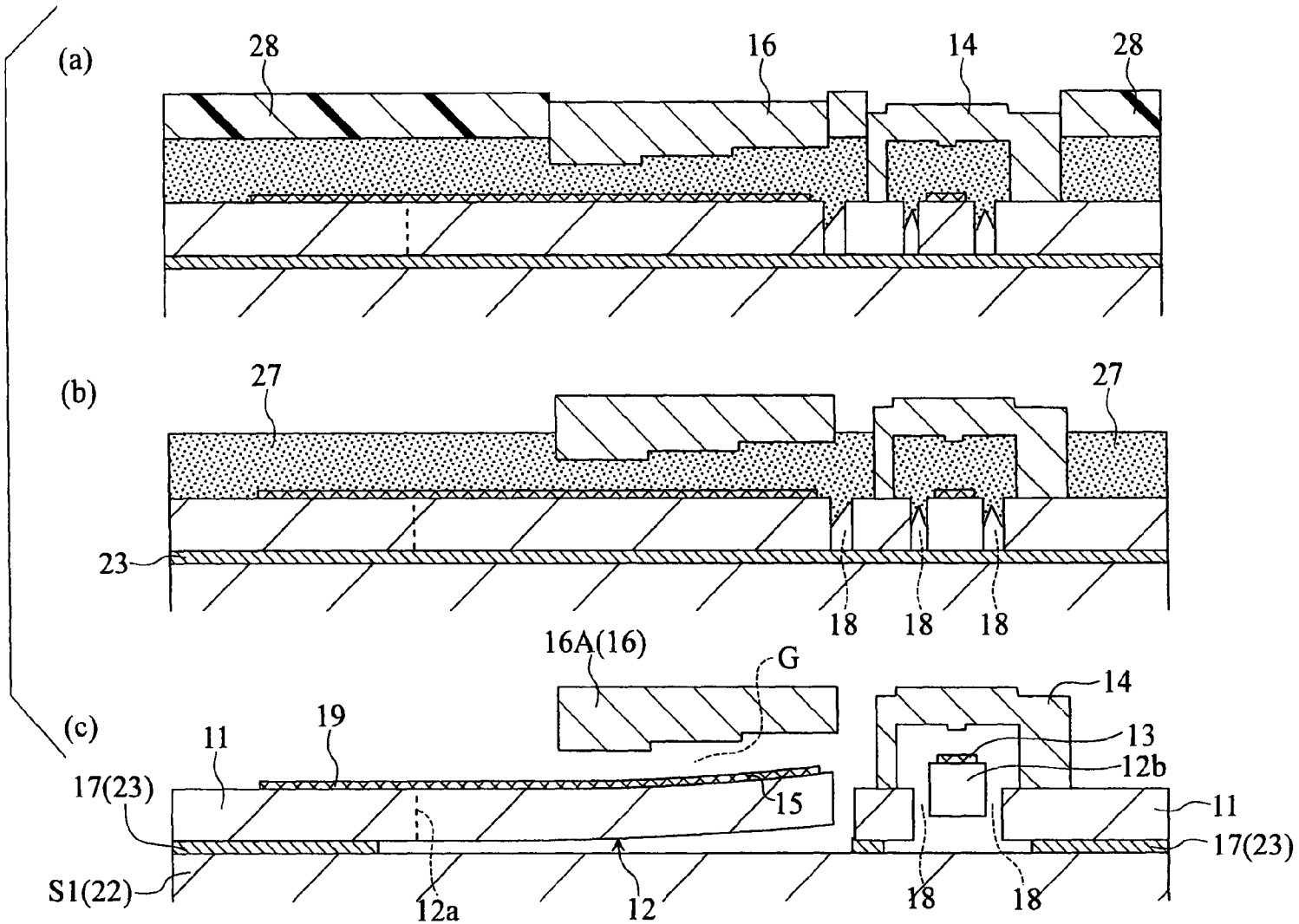
FIG. 11 shows steps following the steps of FIG. 10.

Next, as shown in FIG. 11(*a*), the contact electrodes 14 and the driver electrode 16 are formed. Specifically, electroplating-is performed to grow e.g. Au at places on the underlying film not covered by the resist pattern 28.

Next, as shown in FIG. 11(*b*) the resist pattern 28 is etched off. Thereafter, portions exposed on the underlying film for electroplating are etched off. Each of these etching processes may be made by wet etching.

Next, as shown in FIG. 11(*c*), the sacrifice layer 27 and part of the intermediate layer 23 are removed. Specifically, wet etching is performed to the sacrifice layer 27 and the intermediate layer 23. In this etching process, first, the sacrifice layer 27 is removed and thereafter, part of the intermediate layer 23 is removed, starting from portions exposed to the slits 18. The etching process is stopped once a gap is formed appropriately, separating the entire movable part 12 from the second layer 22. As a result of the removal, a boundary layer 17 is left in the intermediate layer 23. The second layer 22 leaves a base substrate S1.

Once this step is over, the movable part 12 has been warped. An internal stress has been developed in the driver electrode 15 and the wiring 19 which are formed in such a way as described above, and this internal stress causes warp in the driver electrode 15 and the wiring 19 as well as in the movable part 12. Specifically, the warp in the movable part 12 brings a free end 12*b* of the movable part 12 closer to the contact electrode 14.

Next, wet etching is performed as necessary, to remove fractions of underlying film (e.g. Mo film) remaining on the contact electrode 14 and the lower surface of the driver electrode 16. Thereafter, the entire device is dried by supercritical drying method. Supercritical drying method enables to avoid sticking phenomenon, i.e. a problem that the movable part 12 sticks to the base substrate S1 for example.

The micro-switching device X1 can be manufactured by following the steps described above. According to the present method, the contact electrodes 14 which have portions to face the contact electrode 13 can be formed thickly on the sacrifice layer 27 by using plating method. Therefore, it is possible to give the pair of contact electrodes 14 a sufficient thickness for achieving a desirably low resistance. Thick contact electrodes 14 are suitable in reducing the insertion loss of the micro-switching device X1.

Figure 12:
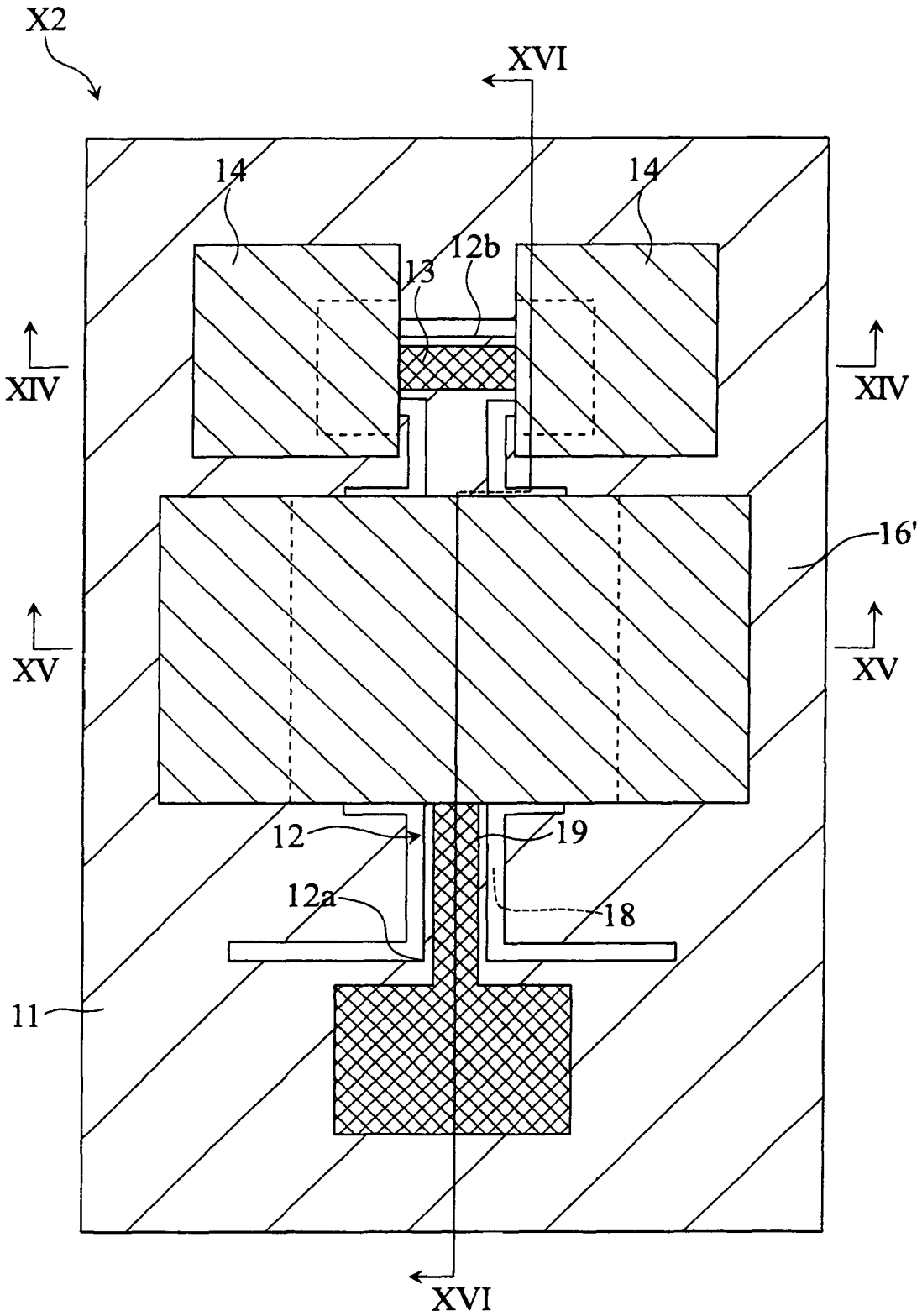
FIG. 12 is a plan view showing a micro-switching device according to a second embodiment of the present invention.
Figure 13:
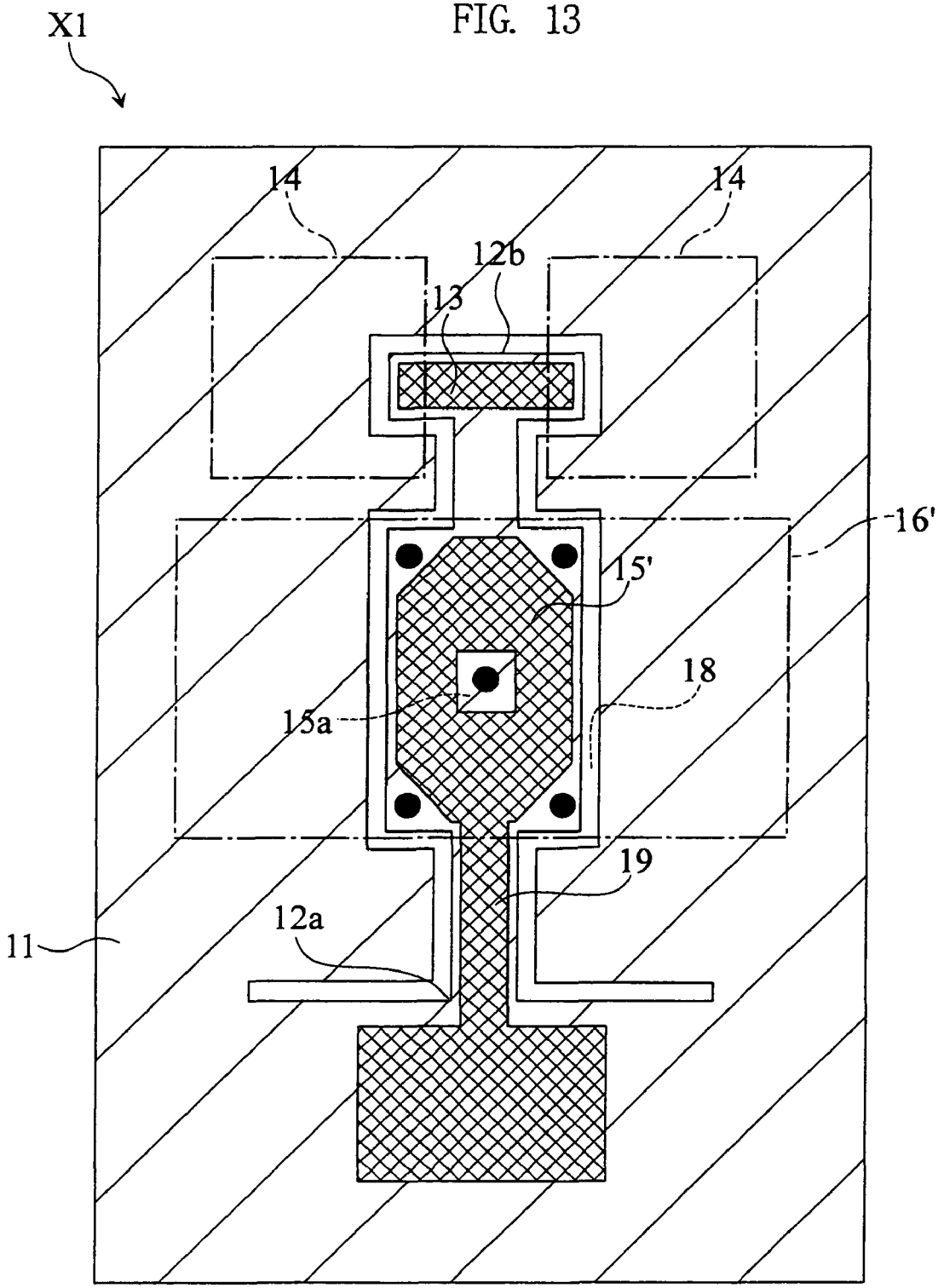
FIG. 13 is a plan view showing the device of FIG. 12, with some parts omitted.
Figure 14:
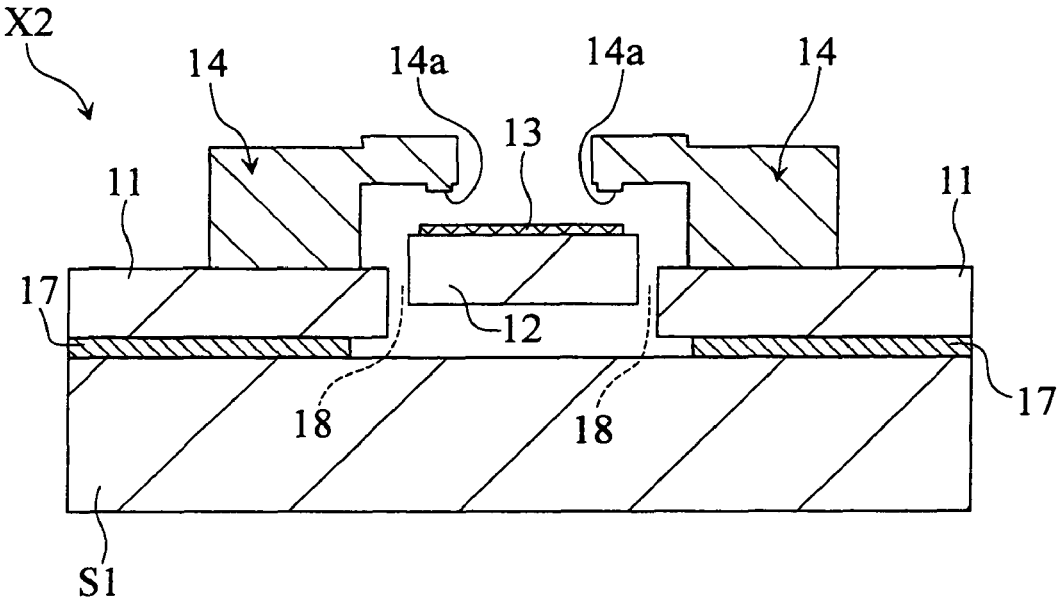
FIG. 14 is a sectional view taken along lines XIV-XIV in FIG. 12.
Figure 15:
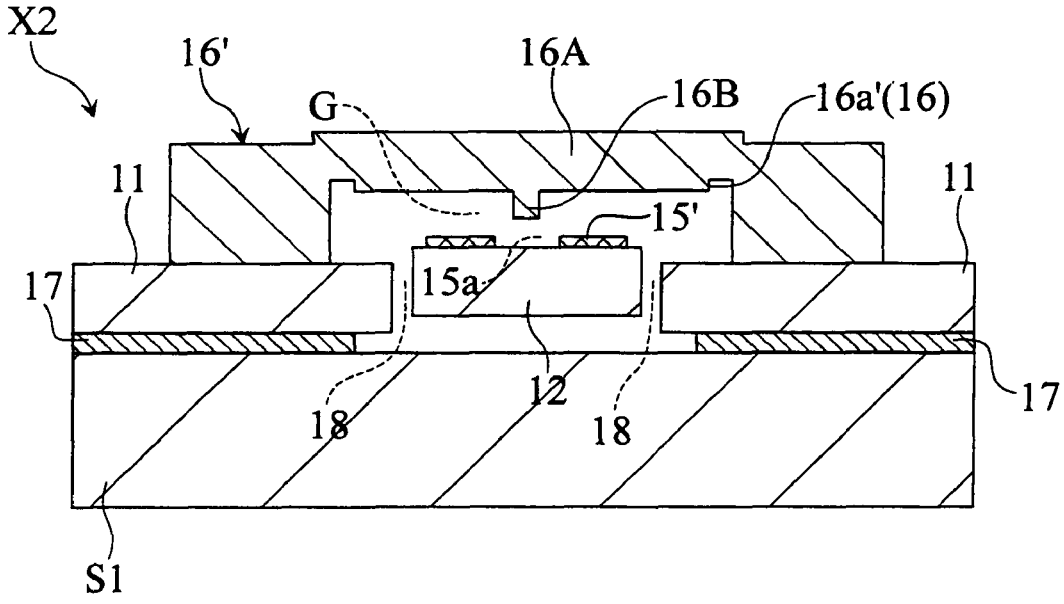
FIG. 15 is a sectional view taken along lines XV-XV in FIG. 12.
Figure 16:
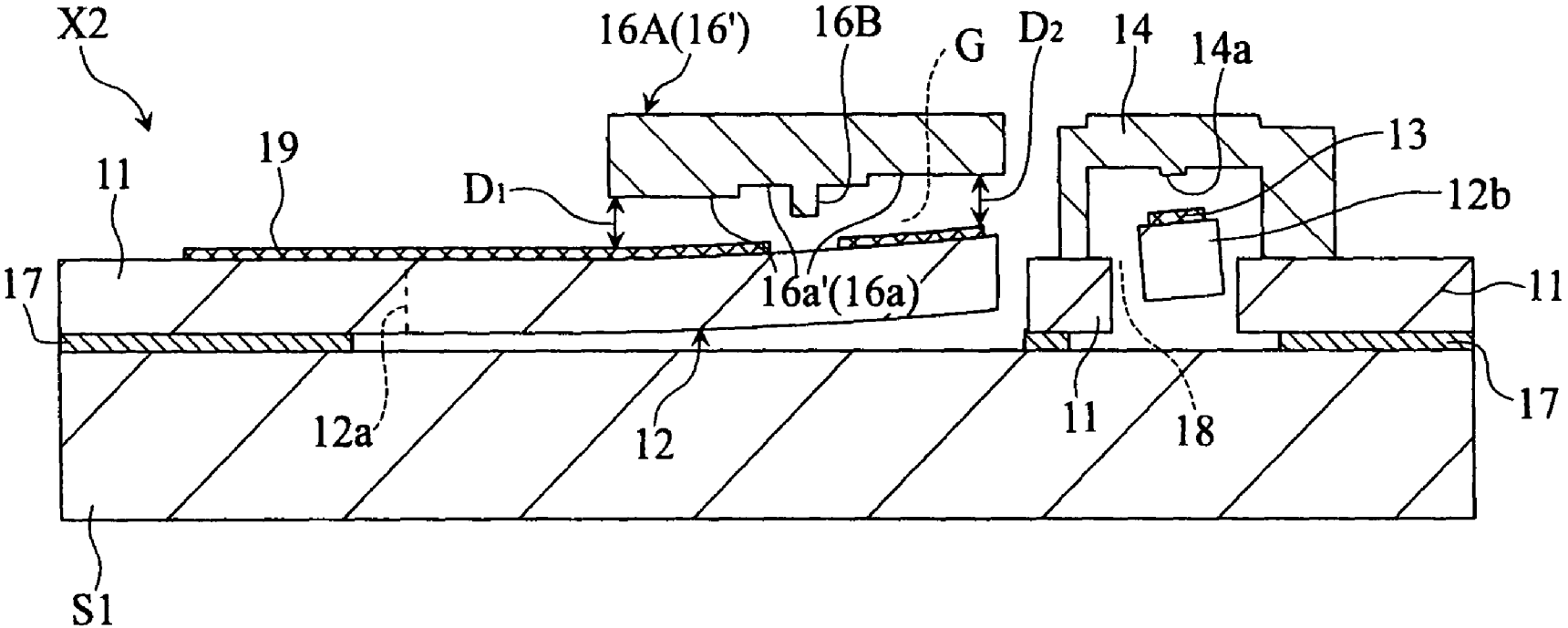
FIG. 16 is a sectional view taken along lines XVI-XVI in FIG. 12.

FIG. 12 through FIG. 16 show a micro-switching device X2 according to a second embodiment of the present invention. FIG. 12 is a plan view of the micro-switching device X2, FIG. 13 is a partial plan view of the micro-switching device X2, and FIG. 14 through FIG. 16 are sectional views taken in lines XIV-XIV, XV-XV, and XVI-XVI in FIG. 12.

The micro-switching device X2 includes a base substrate S1, a fixing member 11, a movable part 12, a contact electrode 13, a pair of contact electrode 14 (shown in phantom lines in FIG. 13), a driver electrode 15' and a driver electrode 16' (shown in phantom lines in FIG. 13). The micro-switching device X2 differs from the micro-switching device X1 in that it has a driver electrode 15' which is different from the driver electrode 15, and the driver electrode 16' which is different from the driver electrode 16.

The driver electrode 15' serves as a movable driver electrode according to the present invention, and as shown in FIG. 13, is on the movable part 12. The driver electrode 15' has an opening 15*a* which, according to the present embodiment, has an octagonal shape. All the other arrangement for the driver electrode 15' are the same as for the driver electrode 15.

Figure 17:
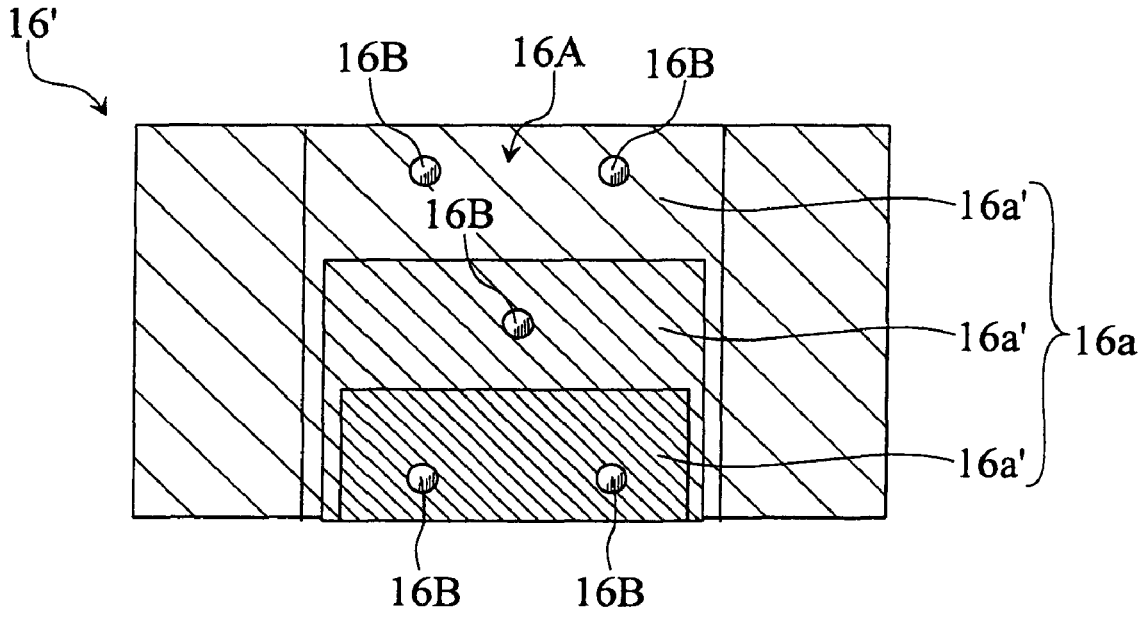
FIG. 17 shows a driver electrode (stationary driver electrode) as viewed from the base substrate.

The driver electrode 16' serves as a stationary driver electrode according to the present invention, has its two ends bonded to the fixing member 11 as shown in FIG. 15, and has an elevated portion 16A which bridges over the driver electrode 15'. As shown in FIG. 16 and also in FIG. 17, the elevated portion 16A has a step structure 16*a* provided by a plurality of steps 16*a*', on a side facing the driver electrode 15'. FIG. 17 is a plan view of the driver electrode 16' as viewed from the side facing the base substrate S1. The driver electrode 16' further has a plurality of projections 16B projecting from the elevated portion 16A toward the driver electrode 15'. Each of the projections 16B is contactable with the movable part 12 when the micro-switching device X2 is in its closed state. In FIG. 13, areas in the movable part 12 contactable by the projections 16B are shown in solid black circles. All the other arrangement of the driver electrode 16' and its step structure 16*a* are the same as of the driver electrode 16 described earlier.

In a non-operating state or open state of the micro-switching device X2, the movable part 12 is in a state of deformation or warp. However, in the micro-switching device X2, the elevated portion 16A of the driver electrode 16' has a step structure 16*a* (in which the step 16*a*' that is farther from the contact electrode 13 is closer to the base substrate S1). This arrangement is suitable for sufficiently reducing the difference between the distance D1 between the driver electrodes 15, 16 on the side farther from the contact electrode 13 and the distance D2 between the driver electrodes 15, 16 on the side closer to the contact electrode 13. Thus, according to the micro-switching device X2, it is possible, just as according to the micro-switching device X1, to make the gap G sufficiently small between the driver electrodes 15, 16, and therefore the micro-switching device X2 is suitable for reducing the driving voltage.

Figure 18:
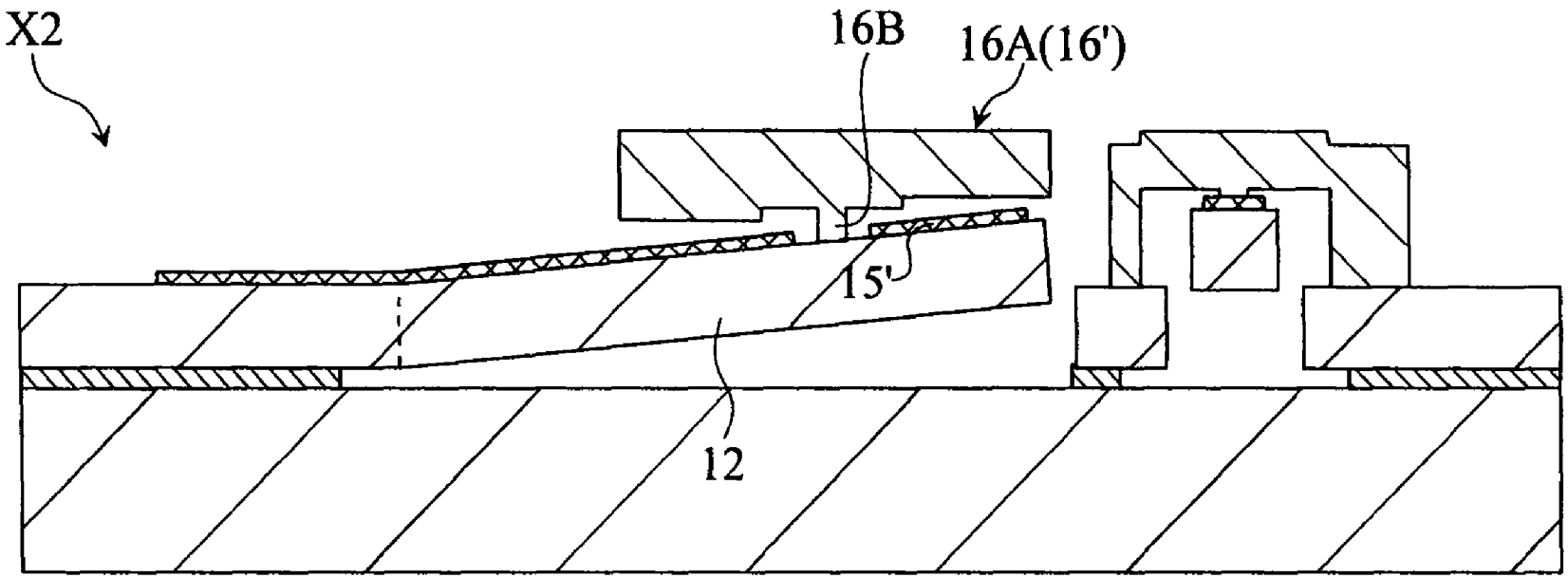
FIG. 18 is a sectional view showing the closed state of the device shown in FIG. 12.
Figure 19:
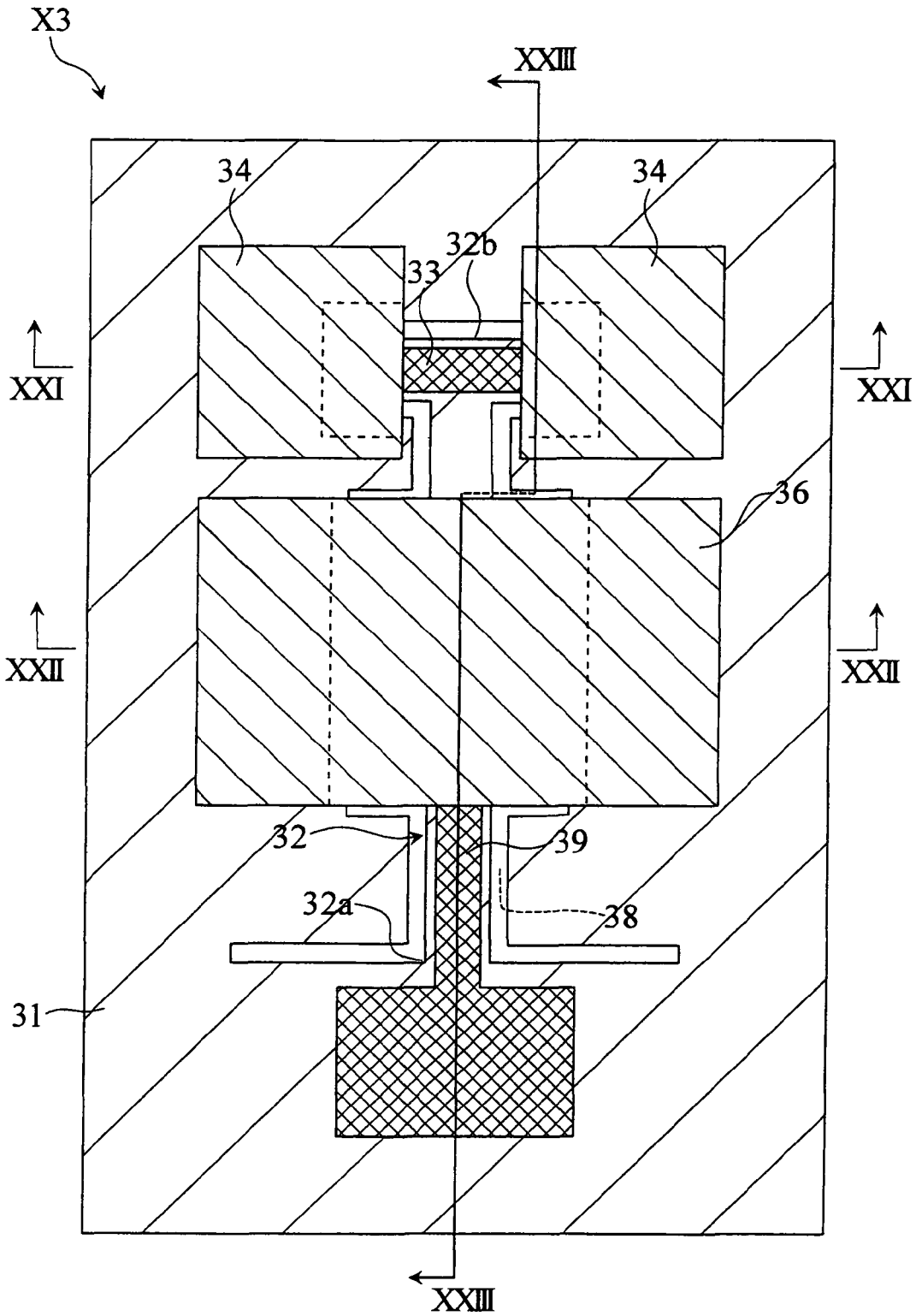
FIG. 19 is a plan view showing a conventional micro-switching device.
Figure 20:
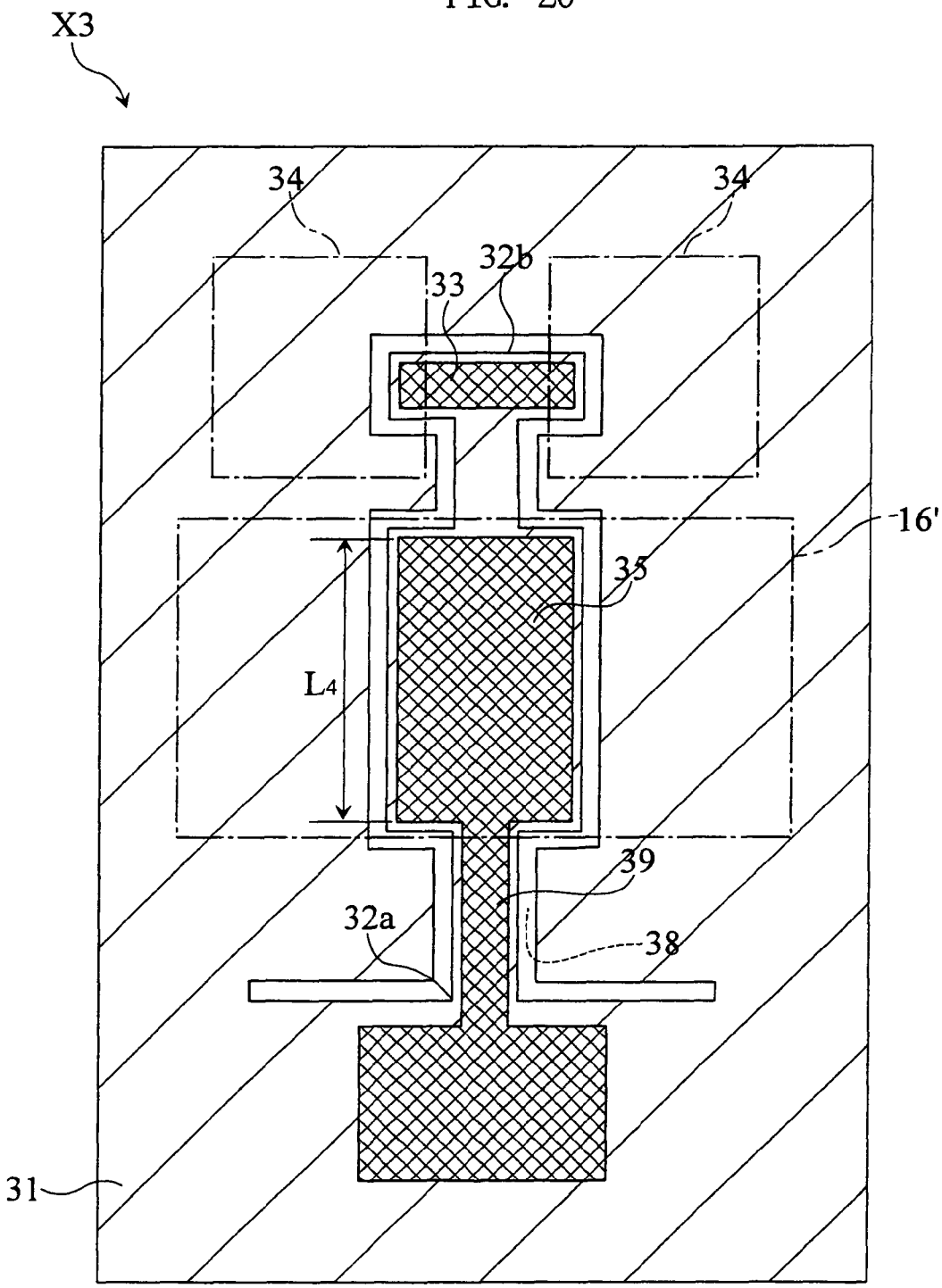
FIG. 20 is a plan view showing the micro-switching device of FIG. 19, with some parts omitted.
Figure 21:
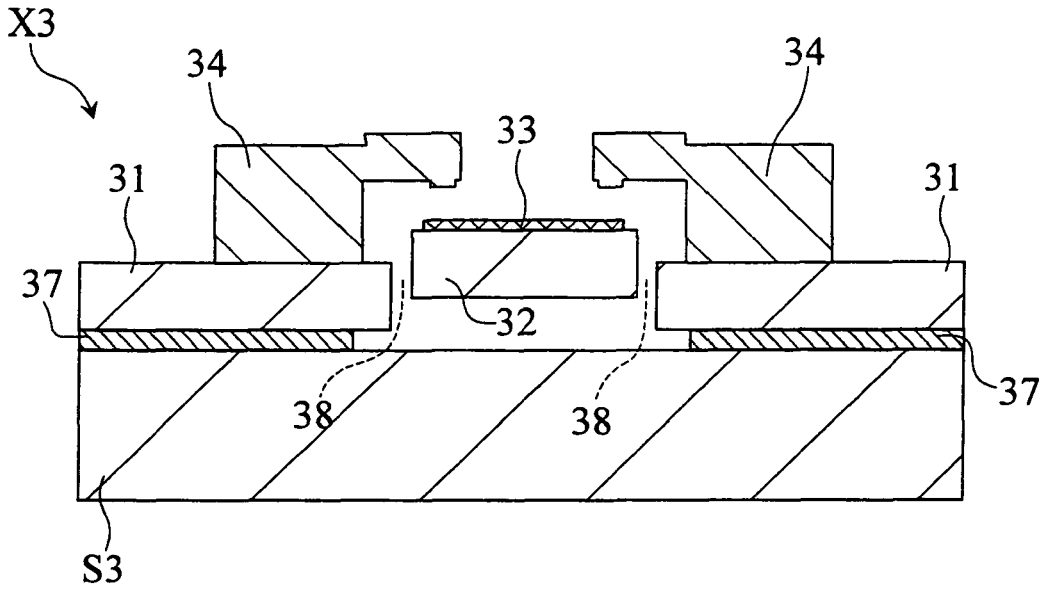
FIG. 21 is a sectional view taken along lines XXI-XXI in FIG. 19.
Figure 22:
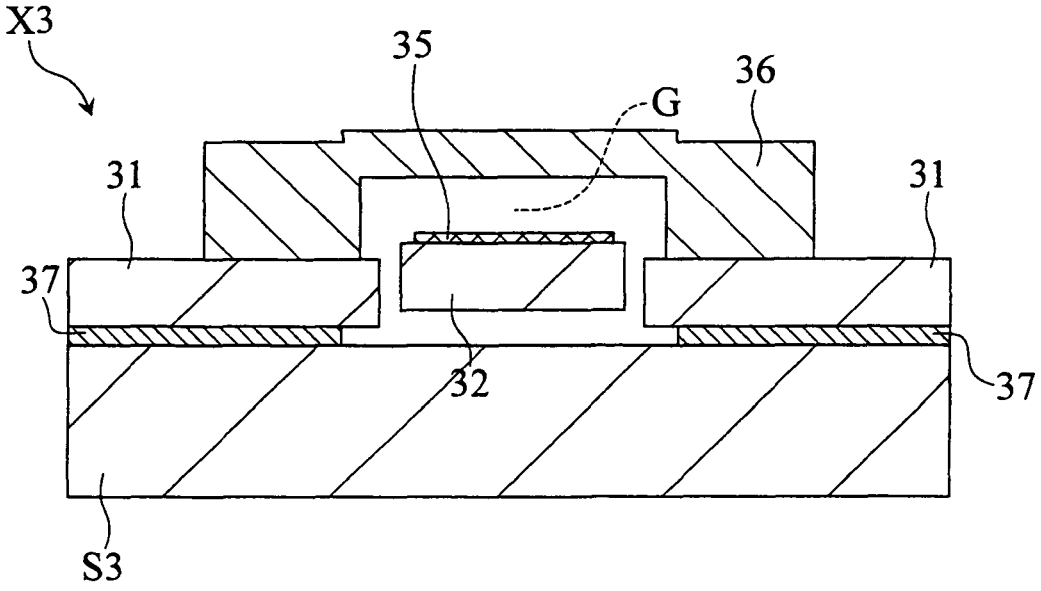
FIG. 22 is a sectional view taken along lines XXII-XXII in FIG. 19.
Figure 23:
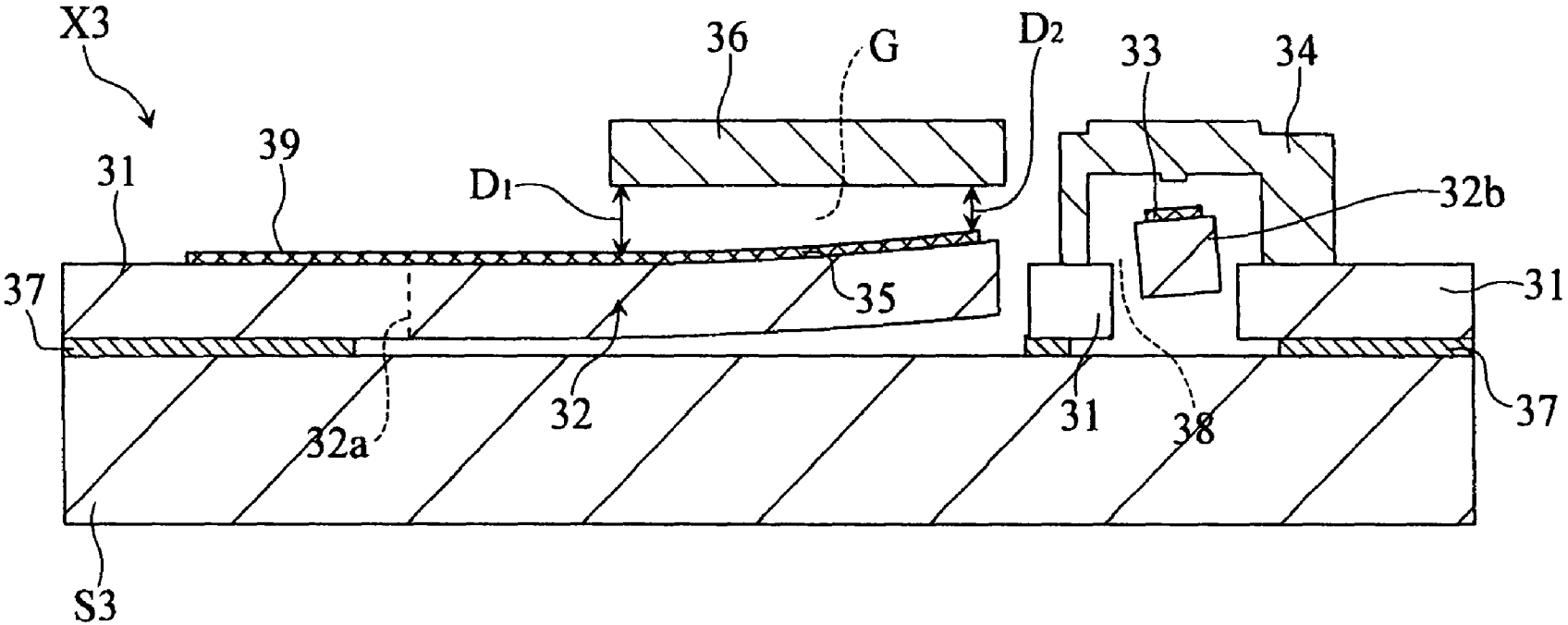
FIG. 23 is a sectional view taken along lines XXIII-XXIII in FIG. 19.

In addition, according to the micro-switching device X2, the projections 16B make contact with the movable part 12 when the device is in the closed state as shown in FIG. 18. This makes possible to prevent short circuiting caused by contact between the driver electrodes 15', 16'.

The invention claimed is:

1. A micro-switching device comprising:

a base substrate;

a fixing member bonded to the base substrate;

a movable part including a stationary end fixed to the fixing member, the movable part extending along the base substrate;

a movable contact electrode provided on the movable part at a surface facing away from the base substrate;

a pair of stationary contact electrodes each including a region facing the movable contact electrode, the stationary contact electrodes bonded to the fixing member;

a movable driver electrode provided between the movable contact electrode and the stationary end on the movable part at a surface facing away from the base substrate; and a stationary driver electrode bonded to the fixing member and including an elevated portion having a region facing the movable driver electrode;

wherein the elevated portion has a step structure including at least three steps which are facing the movable driver electrode, said at least three steps being closer to the base substrate as the steps are farther from the movable contact electrode, and wherein in a non-operating state, the movable part and the movable driver electrode are warped in a manner such that a distance between the movable driver electrode and one of said at least three steps is substantially equal to a distance between the movable driver electrode and another of said at least three steps.

2. The micro-switching device according to claim 1, wherein the stationary driver electrode includes a projection protruding from the elevated portion toward the movable driver electrode.

3. The micro-switching device according to claim 2, wherein the movable driver electrode on the movable part is formed with an opening for partial exposure of the movable part, the opening corresponding in position to the projection.

4. The micro-switching device according to claim 1, wherein the steps change in closeness to the base substrate as a function of distance along a direction in which the movable part extends along the base substrate, the direction being from the stationary end of the movable part toward a movable-contact portion of the movable part.

* * * * *